US007891407B2

(12) United States Patent
Schlichting et al.

(10) Patent No.: US 7,891,407 B2
(45) **Date of Patent: *Feb. 22, 2011**

(54) METHOD AND APPARATUS FOR LOCALIZED CONTROL OF HEAT FLUX IN THIN CAST STRIP

(75) Inventors: Mark Schlichting, Crawfordsville, IN (US); Walter Blejde, Brownsburg, IN (US); Eugene Pretorius, Mt. Pleasant, SC (US)

(73) Assignee: Nucor Corporation, Charlotte, NC (US)

( * ) Notice: Subject to any disclaimer, the term of this patent is extended or adjusted under 35 U.S.C. 154(b) by 470 days.

This patent is subject to a terminal disclaimer.

(21) Appl. No.: 11/945,112

(22) Filed: Nov. 26, 2007

(65) Prior Publication Data

US 2008/0083525 A1 Apr. 10, 2008

Related U.S. Application Data

(63) Continuation-in-part of application No. 11/302,485, filed on Dec. 13, 2005, now Pat. No. 7,299,857, which is a continuation-in-part of application No. 11/010,625, filed on Dec. 13, 2004, now abandoned.

(51) Int. Cl.
*B22D 11/06* (2006.01)

(52) U.S. Cl. ..... 164/452; 164/428; 164/480; 164/475

(58) Field of Classification Search ..... 164/451–455, 164/151.4, 154.7, 479–482, 428–434, 475
See application file for complete search history.

(56) References Cited

U.S. PATENT DOCUMENTS

| | | | |
|---|---|---|---|
| 3,345,738 | A | 10/1967 | Mizikar et al. |
| 3,795,025 | A | 3/1974 | Sadamitsu |
| 4,250,950 | A | 2/1981 | Buxmann et al. |
| 4,301,855 | A | 11/1981 | Suzuki et al. |
| 4,368,084 | A | 1/1983 | Irie et al. |

(Continued)

FOREIGN PATENT DOCUMENTS

| | | |
|---|---|---|
| EP | 0309247 | 3/1989 |
| EP | 0 409 645 | 1/1991 |
| EP | 0523643 | 1/1993 |
| EP | 0714716 | 5/1996 |
| EP | 0800881 | 10/1997 |

(Continued)

OTHER PUBLICATIONS

International Search Report in PCT/AU2008/001719, dated Feb. 5, 2009.

(Continued)

*Primary Examiner*—Kuang Lin
(74) *Attorney, Agent, or Firm*—Hahn Loeser & Parks, LLP

(57) ABSTRACT

A method of and apparatus for continuous casting of thin cast strip including removing oxides from the casting surface of each casting roll by contacting the casting surface of each casting roll with a rotating brush between the nip and the casting area, determining the temperature in segments along the casting roll surfaces or across the cast strip adjacent the nip, and delivering gas adjacent the casting surface between the rotating cleaning brush and the casting area regulated in segments corresponding to the determined temperature in the segment to control the quality of the strip produced. The gas delivery adjacent the casting surface between the rotating brush and the casting area may be done in at least five segments along the casting roll, and the temperature determination step may be done in a continuum such as by a scanning pyrometer. The temperature determination of the cast strip may be done between 0.2 and 1 meter from the nip.

15 Claims, 8 Drawing Sheets

U.S. PATENT DOCUMENTS

| | | | | |
|---|---|---|---|---|
| 4,530,597 | A | 7/1985 | Itaya et al. | |
| 4,588,021 | A | 5/1986 | Bergeron et al. | |
| 4,793,400 | A | 12/1988 | Wood | |
| 4,865,117 | A | 9/1989 | Bartlett et al. | |
| 4,887,662 | A | 12/1989 | Tanaka et al. | |
| 4,934,443 | A * | 6/1990 | Honeycutt et al. | 164/479 |
| 4,986,336 | A | 1/1991 | Fukase et al. | |
| 5,103,895 | A | 4/1992 | Furuya et al. | |
| 5,227,251 | A | 7/1993 | Suichi et al. | |
| 5,307,861 | A | 5/1994 | Townsend | |
| 5,366,001 | A | 11/1994 | Freedman et al. | |
| 5,368,088 | A | 11/1994 | Furuya et al. | |
| 5,520,243 | A | 5/1996 | Freeman et al. | |
| 5,575,327 | A | 11/1996 | Kato | |
| 5,588,479 | A | 12/1996 | Leadbeatter et al. | |
| 5,590,701 | A | 1/1997 | Fukase | |
| 5,651,413 | A | 7/1997 | Williams et al. | |
| 5,660,224 | A | 8/1997 | Barbe et al. | |
| 5,701,948 | A | 12/1997 | Strezov et al. | |
| 5,720,336 | A | 2/1998 | Strezov | |
| 5,787,967 | A | 8/1998 | Vendeville et al. | |
| 5,965,277 | A | 10/1999 | Tamaka et al. | |
| 6,059,014 | A | 5/2000 | Strezov | |
| 6,120,621 | A | 9/2000 | Jin et al. | |
| 6,575,225 | B1 * | 6/2003 | Hohenbichler et al. | 164/480 |
| 6,886,623 | B2 | 5/2005 | Kato et al. | |
| 7,073,565 | B2 | 7/2006 | Nikolovski et al. | |
| 7,296,614 | B2 | 11/2007 | Schlichting et al. | |
| 7,299,857 | B2 * | 11/2007 | Schlichting et al. | 164/480 |
| 2002/0088602 | A1 | 7/2002 | Kato et al. | |
| 2002/0166653 | A1 | 11/2002 | Yamamura et al. | |
| 2006/0124271 | A1 | 6/2006 | Schlichting et al. | |
| 2008/0011449 | A1 | 1/2008 | Schlichting | |

FOREIGN PATENT DOCUMENTS

| | | |
|---|---|---|
| EP | 0 865 850 | 9/1998 |
| EP | 0 887 145 | 12/1998 |
| FR | 1364717 | 6/1964 |
| FR | 2 771 034 | 5/1999 |
| JP | 56-062660 | 5/1981 |
| JP | 58-058963 | 4/1983 |
| JP | 60-040650 | 3/1985 |
| JP | 3-128149 | 5/1991 |
| JP | 3-230849 | 10/1991 |
| JP | 4-041052 | 2/1992 |
| JP | 4-066247 | 3/1992 |
| JP | 5-177311 | 7/1993 |
| JP | 6-134553 | 5/1994 |
| JP | 8-294751 | 11/1996 |
| JP | 29393 | 2/1997 |
| JP | 29394 | 2/1997 |
| JP | 11-207445 | 8/1999 |
| JP | 2000-280049 | 10/2000 |
| JP | 2001-58245 | 3/2001 |
| JP | 2002-113555 | 4/2002 |
| JP | 2002-210544 | 7/2002 |
| KR | 2003-052333 | 6/2003 |
| RU | 2030957 | 3/1995 |
| WO | 9402269 | 3/1994 |
| WO | 03/055624 | 7/2003 |
| WO | 2004/065039 | 8/2004 |
| WO | 2006064476 | 6/2006 |

OTHER PUBLICATIONS

Written Opinion in PCT/AU2008/001719, dated Feb. 5, 2009.
International-Type Search Report mailed on Jul. 14, 2008 from the Australian Patent Office in AU Patent Application No. 2008903229, 2 pages.
International Search Report for PCT/IB2005/054225.
Written Opinion for PCT/IB2005/054225.
International Search Report for PCT/IB2005/054226.
Written Opinion for PCT/IB2005/054226.

* cited by examiner

METHOD AND APPARATUS FOR LOCALIZED CONTROL OF HEAT FLUX IN THIN CAST STRIP

This application is a continuation-in-part of application Ser. No. 11/302,485, filed Dec. 13, 2005, now U.S. Pat. No. 7,299,857, which is a continuation-in-part of application Ser. No. 11/010,625, filed Dec. 13, 2004 now abandoned. Application Ser. Nos. 11/302,485 and 11/010,625 are incorporated herein by reference.

BACKGROUND AND SUMMARY

This invention relates to the casting of steel strip by a twin roll caster. In a twin roll caster, molten metal is introduced between a pair of counter-rotated horizontally positioned casting rolls, which are internally cooled so that metal shells solidify on the moving roll surfaces and are brought together at the nip between them to produce a thin cast strip product delivered downwardly from the nip. The term "nip" between the casting rolls is used herein to refer to the general region at which the rolls are closest together. The molten metal may be poured from a ladle into a smaller vessel, from which it flows through a metal delivery nozzle located above the nip forming a casting pool of molten metal supported on the casting surfaces of the rolls. This casting pool is usually confined between side plates or dams held in sliding engagement with end surfaces of the rolls so as to dam the two ends of the casting pool against outflow.

When casting steel strip in a twin roll caster, the casting pool will generally be at a temperature in excess of 1550° C., and usually 1600° C. and greater. It is necessary to achieve very rapid cooling of the molten steel over the casting surfaces of the rolls in order to form solidified shells in the short period of exposure on the casting surfaces to the molten steel casting pool during each revolution of the casting rolls. Moreover, it is important to achieve even solidification so as to avoid distortion of the solidifying shells which come together at the nip to form the steel strip. Distortion of the shells can lead to surface defects known as "crocodile skin surface roughness." Crocodile skin surface roughness is known to occur with high carbon levels above 0.065% and even with carbon levels below 0.065% by weight carbon. Crocodile skin roughness involves periodic rises and falls in the strip surface of 40 to 80 microns, in periods of 5 to 10 millimeters, measured by profilometer.

We have found that with carbon levels below about 0.065% by weight the formation of crocodile skin surface roughness is directly related to the heat flux between the molten metal and the surface of the casting rolls, and that the formation of quality cast strip can be controlled by controlling the heat flux between the molten metal and the surface of the casting rolls. As build-up of oxides on the surface of the casting rolls affect the heat transfer through the surface, we have also found that by controlling the energy exerted by rotating brushes peripherally in contact with the casting surfaces of each casting roll, heat flux between the molten metal and the surface of the casting rolls, and in turn quality of the thin cast strip.

This relationship between the heat flux from the molten metal and the surface of the casting rolls and the casting of quality thin cast strip has been found to occur whether the casting roll surfaces are smooth or textured. We have also found that the texture of the casting surfaces of the casting rolls changes during casting with oxide build-up. This change can cause a change in heat flux from the molten metal to the casting roll surfaces and in turn changes the quality of the thin cast strip. As disclosed and claimed in our U.S. application Ser. No. 11/302,485 and published as US 2006-0237162, by controlling the heat flux between the molten metal and the casting roll surfaces, high fluctuations in the heat flux should be avoided during the formation of the metal shells during casting, and in turn control the formation of crocodile skin surface roughness in the thin cast strip produced.

We have now found that by measuring the temperatures of casting surfaces along the length of the casting rolls, across the width of the cast strip adjacent the nip, or both, that interfacial heat transfer coefficient between the molten metal in the casting pool and the casting surfaces of the casting rolls can be monitored and controlled. The measured temperatures are then used to regulate gas delivery within different segments along the surface of the casting roll adjacent the contact of the cleaning brushes. In addition, the energy of the rotating brush against the casting roll also may be controlled at the same time based on the casting speed by varying the application pressure, the angle of contact with the casting roll surfaces, the speed of rotation, or a combination thereof, with an electric, pneumatic or hydraulic motor rotating the brush against the casting surface. The heat flux may also be measured in combination by any available method to improve the quality of cast strip produced.

We have now found that during the casting operation, the temperature of the casting roll at the casting surface will vary along the length indicating a build-up of oxides and corresponding variation in heat flux along the length of the casting roll. Such heat flux variation along the length of the roll, in turn, can cause variations in surface quality across the cast strip width as the strip exits the casting rolls. The variation in temperature and heat flux along the length of a casting roll also causes a temperature variation across the width of the cast strip. Thus, by measuring the temperature variation along a casting roll or across the cast strip, the heat flux variation across the roll and in turn strip quality can be directly monitored, and by utilizing such measured temperature to control localized delivery of gas in segments along the casting rolls adjacent the cleaning brushes, localized control of heat flux can be achieved and quality of cast strip can be improved.

A method of continuous casting of thin cast strip is disclosed that comprises the steps of:

assembling a pair of counter-rotating casting rolls laterally to form a nip between circumferential casting surfaces of the rolls through which metal strip may be cast;

forming a casting pool of molten metal supported on the casting surfaces of the casting rolls above the nip in a casting area with a protective atmosphere;

assembling a rotatable cleaning brush peripherally to contact the casting surface of each casting roll in contact with the casting surfaces between the nip and the casting area;

counter-rotating the casting rolls such that the casting surfaces of the casting rolls each travel toward the nip to produce a cast strip downwardly from the nip;

removing oxides from the casting surface of each casting roll by contacting the casting surface of each casting roll with the rotating cleaning brush;

determining temperatures in segments along the length of at least one of the casting rolls, of the cast strip in segments laterally across the strip adjacent the nip, or both; and delivering gas at the casting surface adjacent the rotating brush varied in segments corresponding to the determined temperatures to provide variable gas delivery in the segments along each casting roll surface adjacent the brushes.

The step of delivering gas at the casting surface may provided by varying gas composition, gas mixture, gas pressure, or a combination thereof, delivered through nozzles in at least three segments extending along the casting surfaces of the casting rolls. In some embodiments there may be five or more segments, and in some embodiments, each gas nozzle may comprise a segment along the surface of the casting roll. In addition, the step of providing gas delivery adjacent the casting roll surface may comprise delivering the gas at the nip formed between the cleaning brush and the casting roll surface, or through a housing adjacent the rotating cleaning brush.

The step of determining temperatures may include measuring temperatures across the casting roll surface at locations in each segment, and then using the measured temperature to control gas delivery across the casting roll surface adjacent the cleaning brushes in each segment. The temperature may be determined adjacent the casting roll nip, in advance of contact of the casting roll surfaces with the cleaning brushes, or after contact of cleaning brushes with the casting roll surfaces and before the casting roll surface again rotates into the casting area where a protective atmosphere is maintained above the casting pool. Alternately or in addition, the step of determining temperatures may involve measuring temperatures of the cast strip in the segments across its width adjacent the nip, and typically between about 0.2 meter and 1 meter from the roll nip.

In any event, the temperatures may be continuously determined along the surface of the casting rolls or across the cast strip adjacent the nip in segments or in a continuum, and directly used to regulate the gas delivery in segments to the casting surfaces adjacent the cleaning brushes, to improve the quality of the cast strip produced. In some embodiments, the temperature across the casting roll or the cast strip, or both, may be determined with sufficient accuracy by location, e.g. by scanning pyrometer, to individually vary the gas delivered to the casting surfaces by each gas delivery nozzle, such that each gas delivery nozzle can be provided as a segment along the surface of the casting roll.

The gas in the gas delivery step may comprise at least one gas selected from the group consisting of nitrogen, argon, helium, hydrogen, water vapor, carbon monoxide, carbon dioxide, dry air or a mixture of two or more thereof.

The method may be used to control the heat transfer coefficient between the casting pool and the casting surface of the casting rolls. The method may further be used to measure the temperature in segments along the casting surfaces and/or the cast strip adjacent the nip to control the energy exerted by the brushes on the casting roll surfaces, and/or the angle of contact of the brushes with the casting roll surfaces, as explained below.

Alternatively, and in addition, disclosed is a method of continuous casting of thin cast strip comprising the steps of:

assembling a pair of counter-rotating casting rolls laterally to form a nip between circumferential casting surfaces of the rolls through which metal strip may be cast;

forming a casting pool of molten metal supported on the casting surfaces of the casting rolls above the nip to provide a casting area with a protective atmosphere;

assembling a rotating cleaning brush peripherally to contact the casting surface of each casting roll in advance of contact of the casting surfaces with the molten metal in the casting area;

counter-rotating the casting rolls such that the casting surfaces of the casting rolls each travel toward the nip to produce a cast strip downwardly from the nip;

removing oxides from the casting surface of each casting roll by contacting the casting surface of each casting roll with the rotating cleaning brush; and determining temperatures in segments of at least one casting roll along the length of the casting roll, of the cast strip along the width as the strip adjacent the nip, or a combination thereof.

The latter method may be used by the operator of the caster to monitor and to identify conditions in the continuous casting where corrective steps should be taken in casting to provide a desired quality of the thin strip being cast.

Further, an apparatus for continuously casting thin cast strip is disclosed that comprises:

a pair of counter-rotating casting rolls spaced laterally to form a nip between circumferential casting surfaces of the rolls through which thin cast strip may be discharged downwardly and a casting area above the nip where a casting pool may be formed with a protective atmosphere there above;

rotating cleaning brushes capable of removing oxides from the casting surfaces of each casting roll, positioned to remove such oxides from the casting surfaces in an area between the nip and the casting area;

at least one temperature sensor capable of providing sensor signals corresponding to the temperatures along at least one casting roll in at least three segments, of the cast strip across the cast strip in at least three segments, or both;

gas nozzles capable of delivering gas adjacent the casting surface of each casting roll between a cleaning brush and the casting area in at least three regulated segments corresponding to the segments where temperature is determined; and a controller capable of receiving the sensor signals and regulating the delivery of gas through at least one nozzle to each segment corresponding to temperatures sensed in each segment.

The gas may comprise at least one gas selected from the group consisting of nitrogen, argon, helium, hydrogen, water vapor, carbon monoxide, carbon dioxide, dry air or a mixture of two or more thereof. The apparatus may include a housing provided adjacent the brush, and wherein the gas nozzles deliver the gas through the housing. The delivery of gas to each segment may be variable in composition, mixture, pressure, or a combination thereof and may be in at least five segments extending along the casting surfaces of the casting rolls. Alternatively or in addition, the temperature sensor may be capable of providing sensor signals corresponding to the temperatures of the cast strip in segments or in a continuum adjacent the nip, and typically between about 0.2 meter and 1 meter from the casting roll nip.

BRIEF DESCRIPTION OF THE DRAWINGS

In order that the invention may be more fully explained, particular embodiments will be described in detail with reference to the accompanying drawings in which.

DETAILED DESCRIPTION OF THE DRAWINGS

Figure 1:
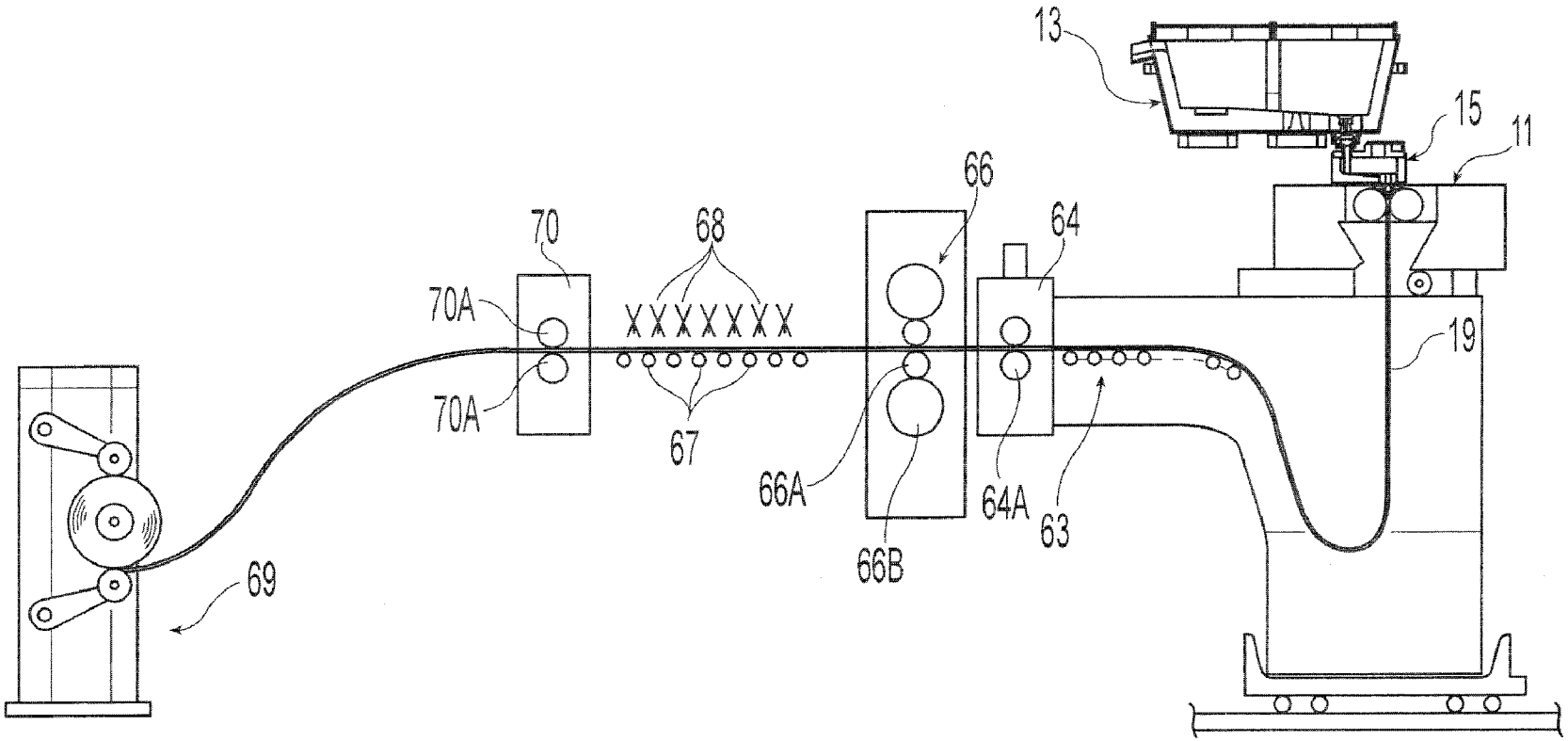
FIG. 1 is a side elevation view of an illustrative twin roll thin strip caster.

The embodiments are described with reference to a twin roll caster shown in FIGS. 1 through 4. The illustrated twin roll caster comprises a main machine frame 11 which supports a pair of laterally positioned casting rolls 12, which may have generally textured circumferential casting surfaces 12A. The casting rolls 12 are counter rotated by an electric, pneumatic or hydraulic motor and gear drive (not shown).

Molten metal, typically of plain carbon steel of less than 0.065% by weight carbon, is supplied during a casting operation from a ladle (not shown) to a tundish 13, then through a refractory ladle outlet shroud 14 to a distributor or movable tundish 15, and from there through a metal delivery nozzle or core nozzle 16 positioned between the casting rolls 12 above the nip 17. Molten metal thus delivered forms a casting pool 10 of molten metal above the nip supported on the casting surfaces 12A of casting rolls 12. This casting pool 10 is confined in the casting area at the ends of the rolls 12 by a pair of side closure or side dam plates 18 (shown in dotted line FIG. 2), which may be held in place against stepped ends of the casting rolls by actuation of a pair of hydraulic cylinder units (not shown). The upper surface of the casting pool 10 (generally referred to as the "meniscus" level) may rise above the lower end of the delivery nozzle 16 so that the lower end of the delivery nozzle is immersed within the casting pool. The casting area includes addition to the casting pool 10 the protective atmosphere above the casting pool 10 to inhibit oxidation of the molten metal in the casting area.

Casting rolls 12 are internally water cooled so that shells solidify on the casting surfaces 12A as the casting surfaces move into contact with and through the casting pool 10 with each revolution of the casting rolls 12. The casting surfaces may be textured, for example, with a random distribution of discrete projections as described and claimed in U.S. Pat. No. 7,073,565. The shells are brought together at the nip 17 between the casting rolls to produce a solidified thin cast strip product 19 delivered downwardly from the nip. The casting rolls 12 may be about 500 millimeters in diameter, or may be up to 1200 millimeters or more in diameter. The length of the casting rolls 12 may be up to about 2000 millimeters, or longer, in order to enable production of strip product of about 2000 millimeters width, or wider, as desired.

FIG. 1 illustrates a twin roll caster producing the thin cast strip 19, which passes across a guide table 63 to a pinch roll stand 64 comprising pinch rolls 64A. Upon exiting the pinch roll stand 64, the thin cast strip may pass through a hot rolling mill 66, comprising a pair of reduction rolls 66A and backing rolls 66B, where the cast strip is hot rolled to flatten and/or reduce the strip to a desired thickness. The rolled strip then passes onto a run-out table 67, where it may be cooled by contact with water supplied via water jets 68 (or other suitable means) and by convection and radiation. In any event, the rolled strip may then pass through a pinch roll stand 70 comprising a pair of pinch rolls 70A, and to a standard coiler 69 where the strip is typically coiled into 20 to 25 ton coils.

The illustrated twin roll caster as thus far described is of the kind which is illustrated and described in some detail in Australian Patent No. 631728 and U.S. Pat. No. 5,184,668 and reference may be made to those patents for appropriate constructional details which form no part of the present invention.

Figure 2:
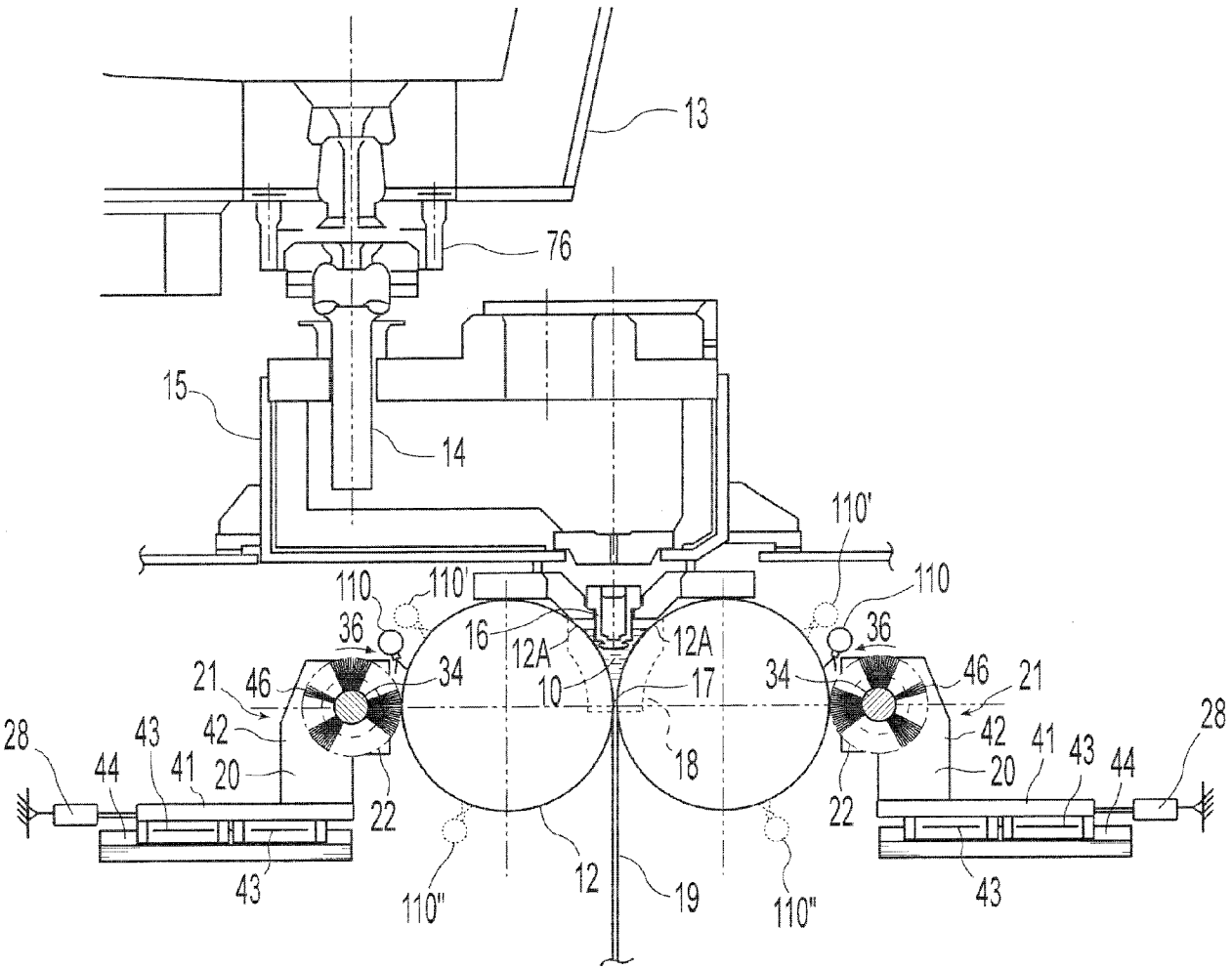
FIG. 2 is an enlarged elevation view of a portion of a twin roll caster showing cleaning brush apparatus.

As shown in FIG. 2, cleaning brush apparatus denoted generally as 21 is disposed adjacent the pair of casting rolls, such that the periphery of the brushes 22 (described below) may be brought into contact with the casting surfaces 12A of the casting rolls 12 to clean oxides from the casting surfaces during casting rolls. The brush apparatus 21 are positioned at opposite sides of caster adjacent the casting rolls, and between the nip 17 and the casting area where the casting rolls enter the protective atmosphere coming into contact with the molten metal casting pool 10.

Each brush apparatus 21 comprises a brush frame 20 which carries a cleaning brush 22, for cleaning the casting surfaces 12A of the casting rolls 12 during a casting campaign. Optionally, a separate sweeper brush (not shown) may be provided for cleaning the casting surfaces 12A of the casting rolls 12 at the beginning and end of a casting campaign as desired. The cleaning brush 22 may be segmented if desired into two or more staggered brush segments, but is generally one brush extended across the casting roll surface 12A of each casting roll 12. The brush frame 20 may comprise a base plate 41 and upstanding side plates 42 on which the cleaning brush 22 is rotatably mounted and driven by a drive device (not shown). Base plate 41 may be fitted with slides 43 which are slidable along a track member 44 to allow the brush frame 20 to be moved toward and away from one of the casting rolls 12, and thereby move the cleaning brush 22 mounted on the brush frame 20 by operation of the main brush actuator 28. The separate sweeper brush, if present, may be mounted on the brush frame 20 and capable of moving independently of the cleaning brush 22. The brush apparatus 21 may be configured so that the cleaning brush 22 may brush oxides from the casting surfaces of the casting rolls without interruption during the casting campaign.

The energy exerted by the cleaning brush 22 against the casting surfaces 12A of the casting rolls 12 is controlled so that the cleaning of the casting roll surfaces is maintained at a specified level during each casting campaign. The energy exerted by the brush on the casting surface 12A is controlled by controlling the pressure of the brush on the casting rolls, or the rotational speed of the cleaning brush 22, or both, based on measurement of the heat flux from the molten metal in the casting pool 10 to the casting surfaces 12A of the casting rolls 12. This pressure and rotational speed will be varied according to the casting speed during a casting campaign. This control may be done manually or automatically as described herein.

The energy exerted by the rotating brush is controlled to maintain the casting surfaces 12A of the casting rolls 12 an established level of cleaning, as described above, during a casting campaign. This may be done by cleaning to expose a majority of the projections of the casting surfaces of the casting rolls 12, and measuring the initial heat flux between the molten metal and the casting rolls. The heat flux is then continually measured in real time either continuously or intermittently during the casting campaign, and then the difference between the real time heat flux and the initial heat flux measured to control the energy exerted by the cleaning brush 22 on the casting roll surfaces 12A of the casting rolls 12. The heat flux, both initially and in real time, can be measured by measuring the difference in temperature of the cooling water circulated through the casting rolls between the inlet and outlet as described in U.S. Pat. Nos. 6,588,493 and 6,755,234.

Although this is the way presently contemplated for measuring the heat, the heat flux can be measured by any available method.

The initial measured heat flux is related to the desired degree of cleaning of the casting roll surfaces 12A, as above described, to control the formation of crocodile skin roughness during the casting campaign. The continual measured heat flux in real time, and the difference between the initial heat flux and the real time heat flux measured, is used to control the energy exerted by the cleaning brush on the casting surfaces 12A so that cleaning of the casting roll surfaces 12A is controlled, and in turn, the formation of crocodile skin roughness on the surface of the cast strip is controlled.

The method can thus be automated by providing a control system (not shown) responsive to sensors monitoring the heat flux, calculating the difference in heat flux from the initial heat flux measured, and controlling the energy exerted by the brush against the casting surface based on the difference in heat flux from the initial heat flux measured. The energy exerted by the cleaning brush against the casting surfaces is capable of being controlled so the cleaning of the exposed casting surface of the casting rolls is controlled throughout the casting campaign and, in turn, the quantity of the cast strip is controlled. The energy exerted by the cleaning brush 22 against the casting surface 12A of the casting roll 12 may be controlled by controlling the application pressure, the speed of rotation, or a combination thereof, with an electric, pneumatic or hydraulic motor rotating the brush coordinated with the casting speed. The brushes 22 may also be mounted and controlled to enable the angle of contact of the brushes with the casting surfaces 12A to be changed, so that different energy can be exerted by the brushes on different segments along the casting roll surfaces.

Figure 4:
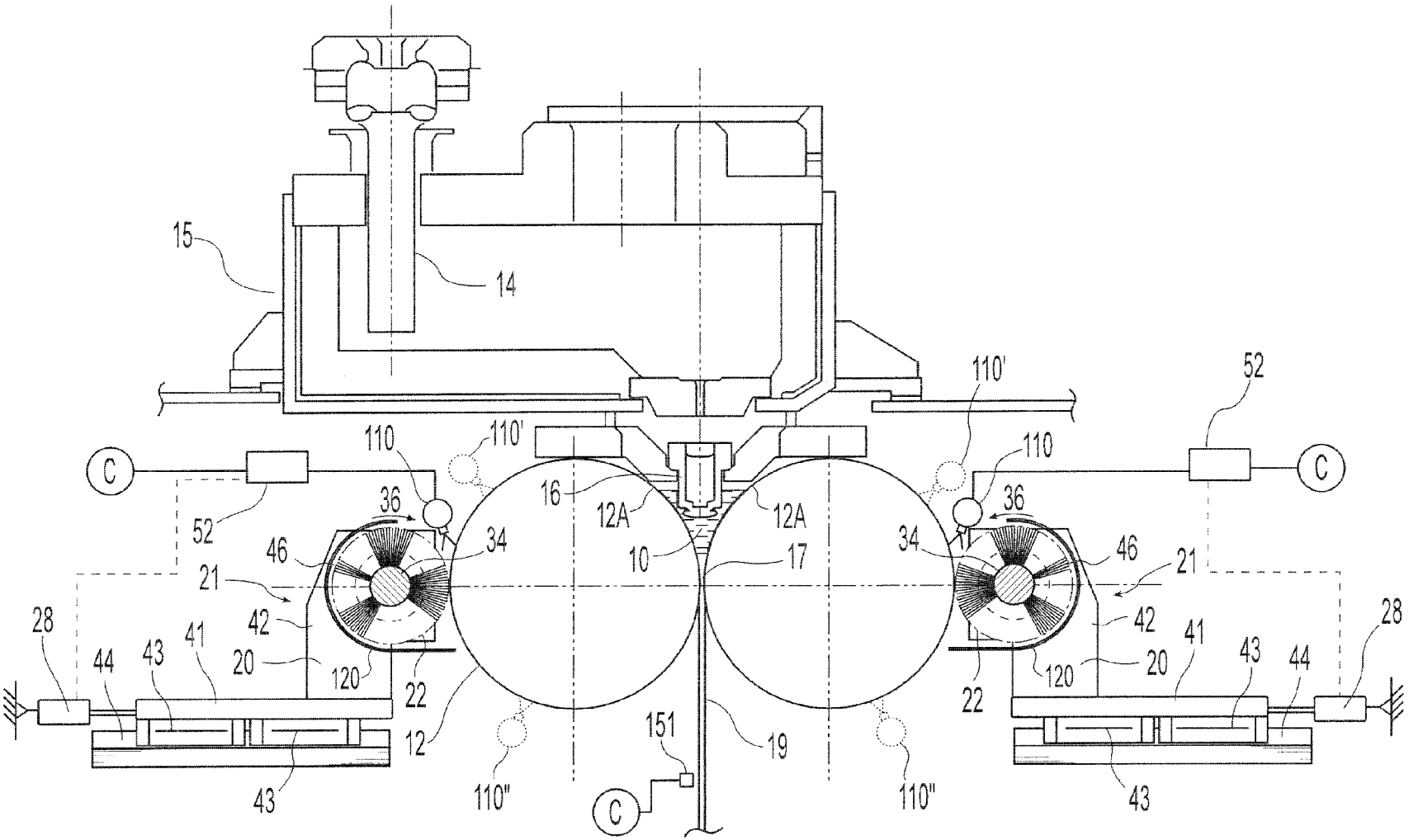
FIG. 4 is an enlarged elevation view of a portion of a twin roll caster showing an alternative cleaning brush apparatus and alternate placement of temperature sensor.
Figure 5:
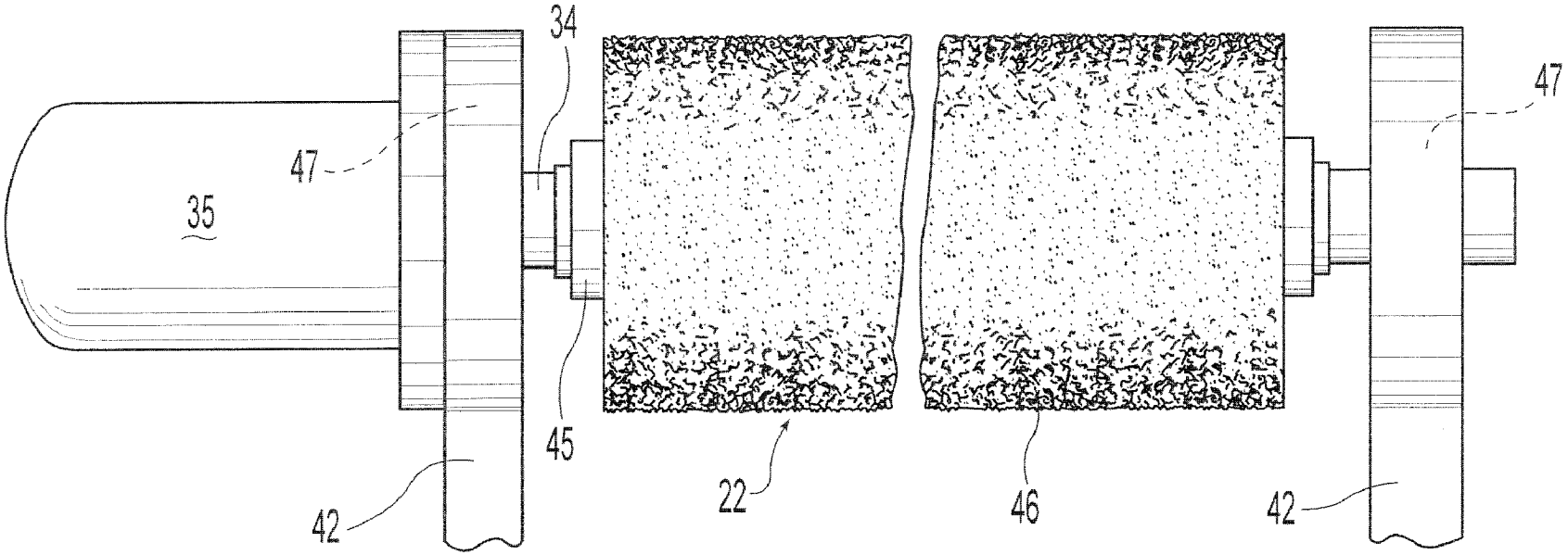
FIG. 5 is a front elevational view of a cleaning brush of the cleaning brush apparatus.

As shown in FIG. 5, the cleaning brush 22 may be in the form of a cylindrical barrel brush having a central body 45 carried on a shaft 34 and fitted with a cylindrical canopy of wire bristles 46. Shaft 34 may be rotatably mounted in bearings 47 in the side plates 42 of the brush frame 20, and a hydraulic, pneumatic, or electric drive motor 35 may be mounted on one of these side plates coupled to the brush shaft 34 so as to rotatably drive the cleaning brush 22 in the opposite direction of the rotation of the casting surfaces 12A of casting roll 12. Although the cleaning brush 22 is shown as a cylindrical barrel brush, it should be understood that this brush may take other forms such as the elongate rectangular brush disclosed in U.S. Pat. No. 5,307,861, the rotary brushing devices disclosed in U.S. Pat. No. 5,575,327 or the pivoting brushes of Australian Patent Application No. PO7602. The precise form of the main brush is not important to the present invention. As shown in FIG. 4, a housing 120 may be provided adjacent each cleaning brush 22 and designed to capture oxides and other contaminants removed by the brush and convey them away in a suitable disposal system by suction or some other suitable device (not shown). Alternately or in addition, the housing 120 may be provided with a suction or vacuum to implement removing oxides and other contaminants removed from the casting surfaces by the brush.

The energy, pressure or rotation speed of the rotating brush can be determined by measuring the torque of the rotating motor. The rotational speed of the cleaning brush 22 can be measured, for example, by a flow meter (not shown) measuring the flow of hydraulic fluid through a hydraulic motor driving the rotating cleaning brush 22. The torque of the motor may be monitored by measuring the pressure differential between inlet and outlet of hydraulic fluid through a hydraulic motor. Alternatively, the torque of the motor may be monitored by measuring the torque with a strain gauge, load cell or other device between the motor and the mount for the bearings 47 (i.e., chock), or other convenient part of the motor mount structure.

Figure 3:
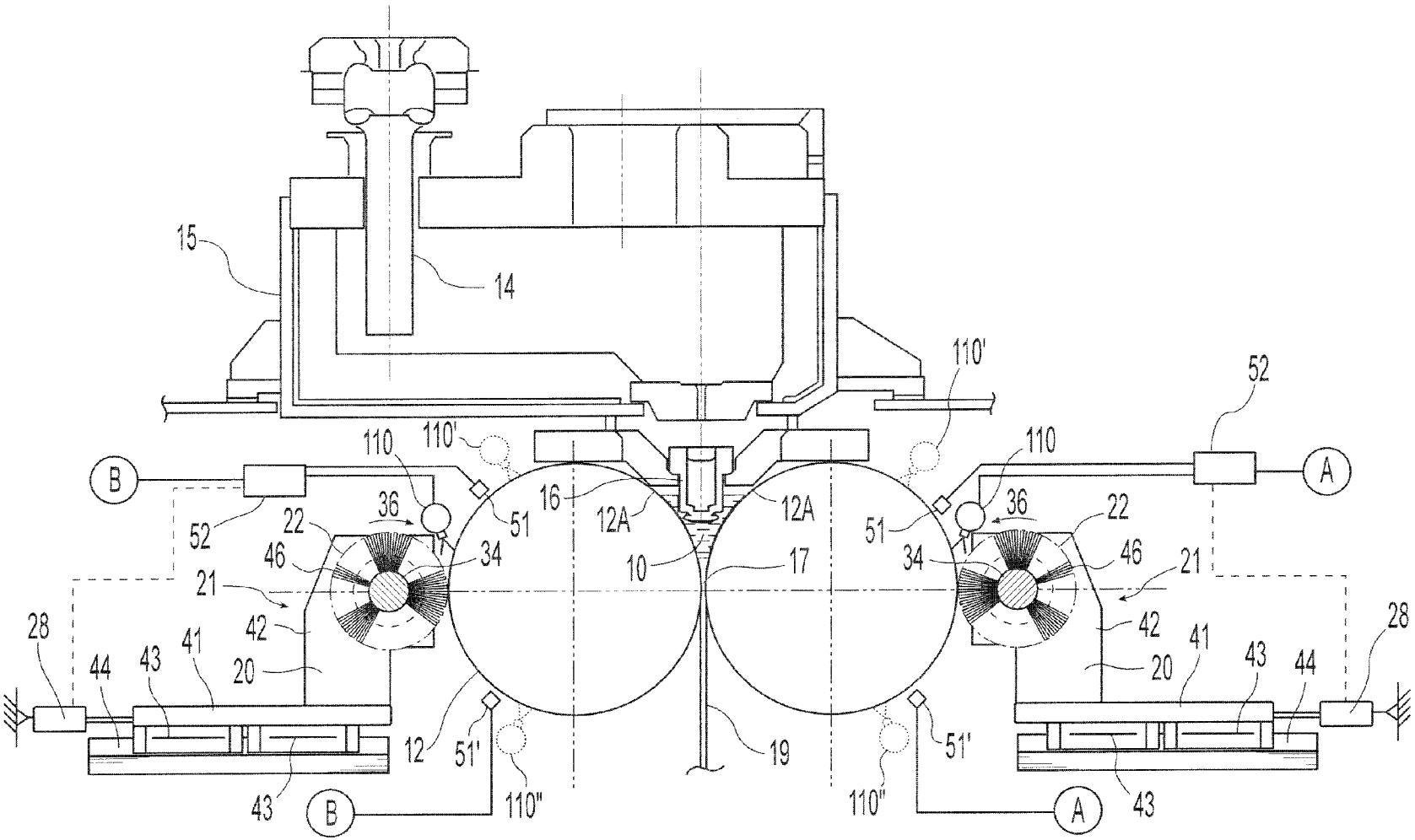
FIG. 3 is an enlarged elevation view of a portion of a twin roll caster illustrating placement of temperature sensor.

Although the cleaning brush 22 may be driven in a direction counter to the rotation of the casting roll, the cleaning brush 22 is usually driven in the same rotational direction as the casting rolls, as indicated by the arrow 36 in FIGS. 2-4. This means that the casting surface 12A is moving in a direction opposite to the movement of the bristles of the cleaning brush 22 against the casting surface of the casting roll.

If used, the separate sweeper brush (not shown) may be in a form of a cylindrical barrel brush which is mounted on the brush frame 20 so as to be moveable on the frame such that it can be brought into engagement with the casting surfaces 12A of casting roll 12, or retracted away from that the casting surface by operation of an actuator independent of whether the main brush is engaged with the casting surfaces of casting roll. This enables the sweeper brush, if present, to be moved independently of the cleaning brush 22 and brought into operation only as desired, such as during the start and finish of a casting run, and withdrawn during normal casting as described below. If used, the sweeper brush may be rotatably driven in tandem with or independently of the cleaning brush 22, and may be driven at the same speed or a speed different from the speed of the casting rolls 12 as desired. The sweeper brush may be used to keep some of the large accretions that can occur at the start and end of the casting run from being dragged across the casting surfaces 12A causing scoring of the casting surface 12A.

Figure 8:
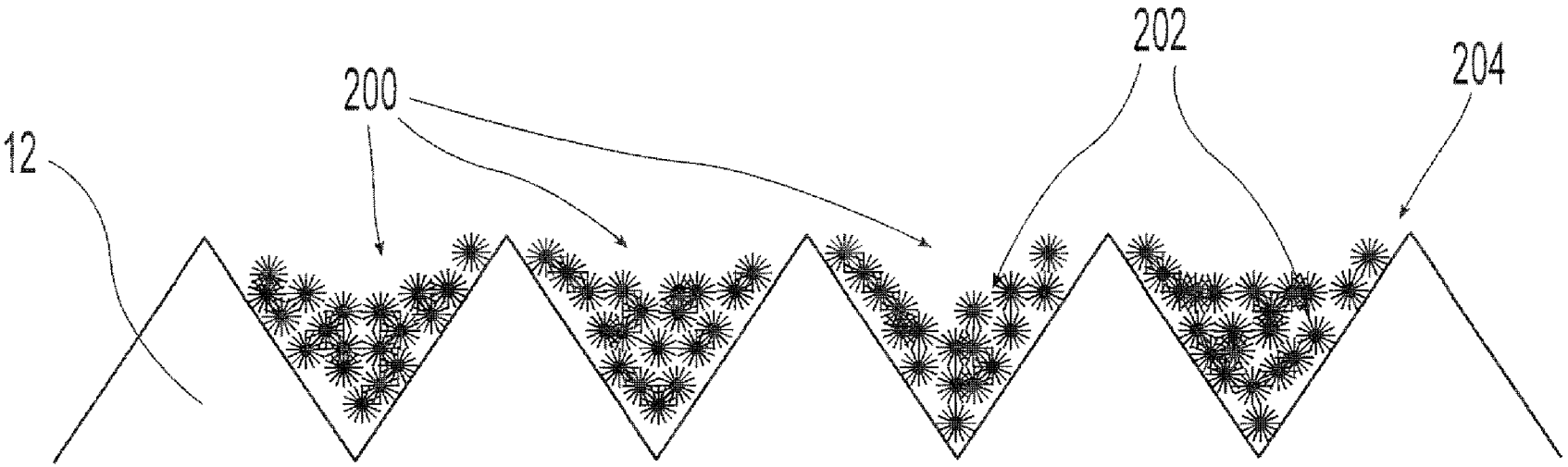
FIG. 8 is a schematic illustrating a portion of the casting surface of a casting roll.

Following the cleaning done in accordance with the present disclosure, as illustrated in FIG. 8 there tends to be residuals in the low areas and entices in the casting surface, and not all exposed projections of the casting roll surface are effectively clean. However, a substantial number of the projections are visible with exposed surfaces as shown, and are cleaned sufficiently that the formation of crocodile skin roughness is inhibited if or eliminated during casting. By using brushes for cleaning the casting roll surfaces, the casting roll surfaces 12A can be wetted by the molten metal in the casting pool 10, and heat flux can be effectively transmitted from the molten metal to the casting rolls when the casting surfaces are in contact with the casting pool so that cast strip quality is maintained.

FIG. 8 is a schematic illustration of a part of the casting surface 12A of a casting roll 12 just after the rotating cleaning brush 22 has removed oxides and contaminants from the casting surfaces 12A. Shown schematically, the texture of the casting surface of the casting roll has projections 204, and shows the majority of the projections 204 can be exposed while the majority of the area of the casting surface 12A remains "buried" with oxides. During the casting operation, the oxides and other contaminants 202 form on the casting roll surfaces 12A. The cleaning brush 22 removes some of these oxides and other contaminants 202 to expose the projections 204 of the casting surface 12A while leaving the areas 200 covered with oxides. It has been found that delivering a boundary layer gas over the casting surface improves the control of the heat flux during the casting campaign.

Figure 6:
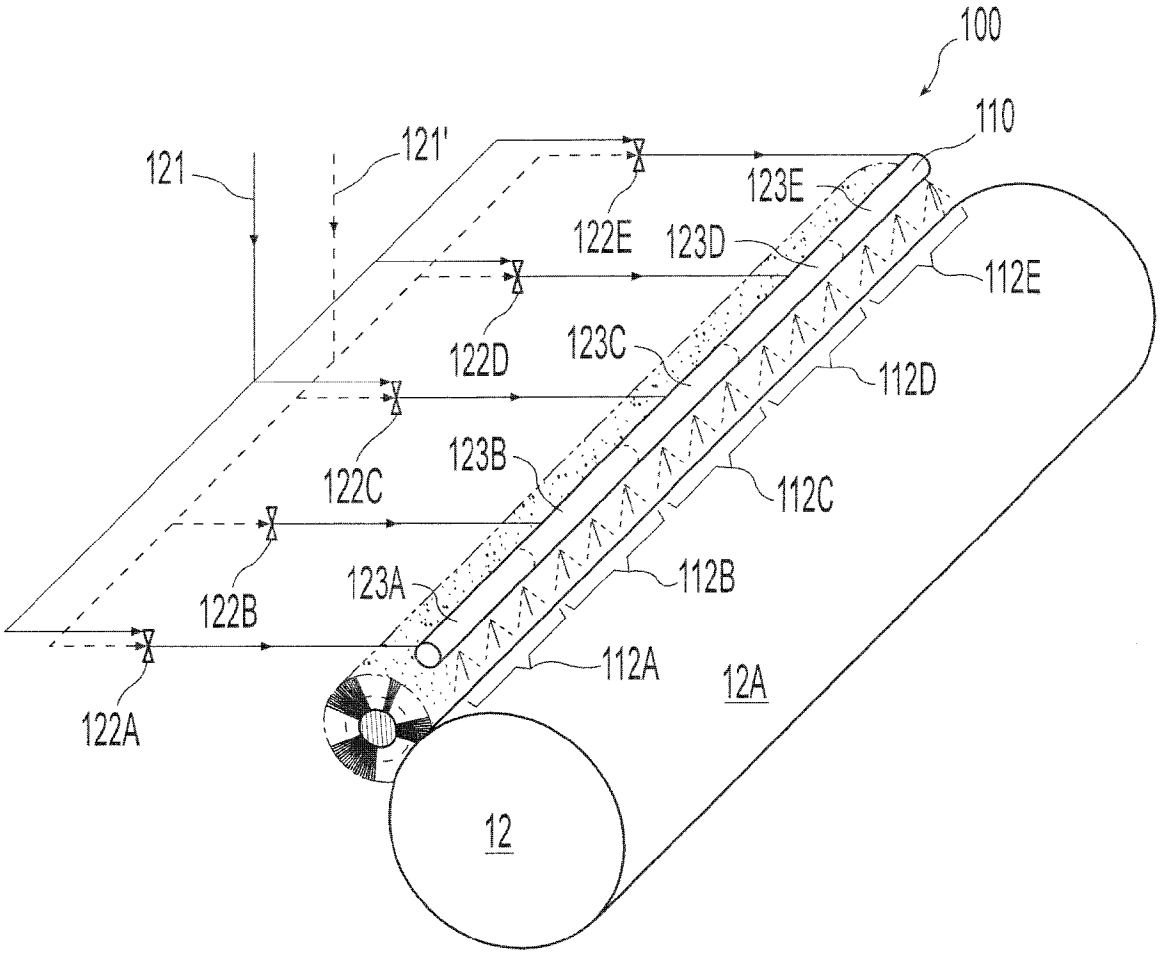
FIG. 6 is a perspective view showing a casting roll and gas nozzles delivering gas to the nip between the cleaning brush and a casting surface of a casting roll in five segments.
Figure 7:
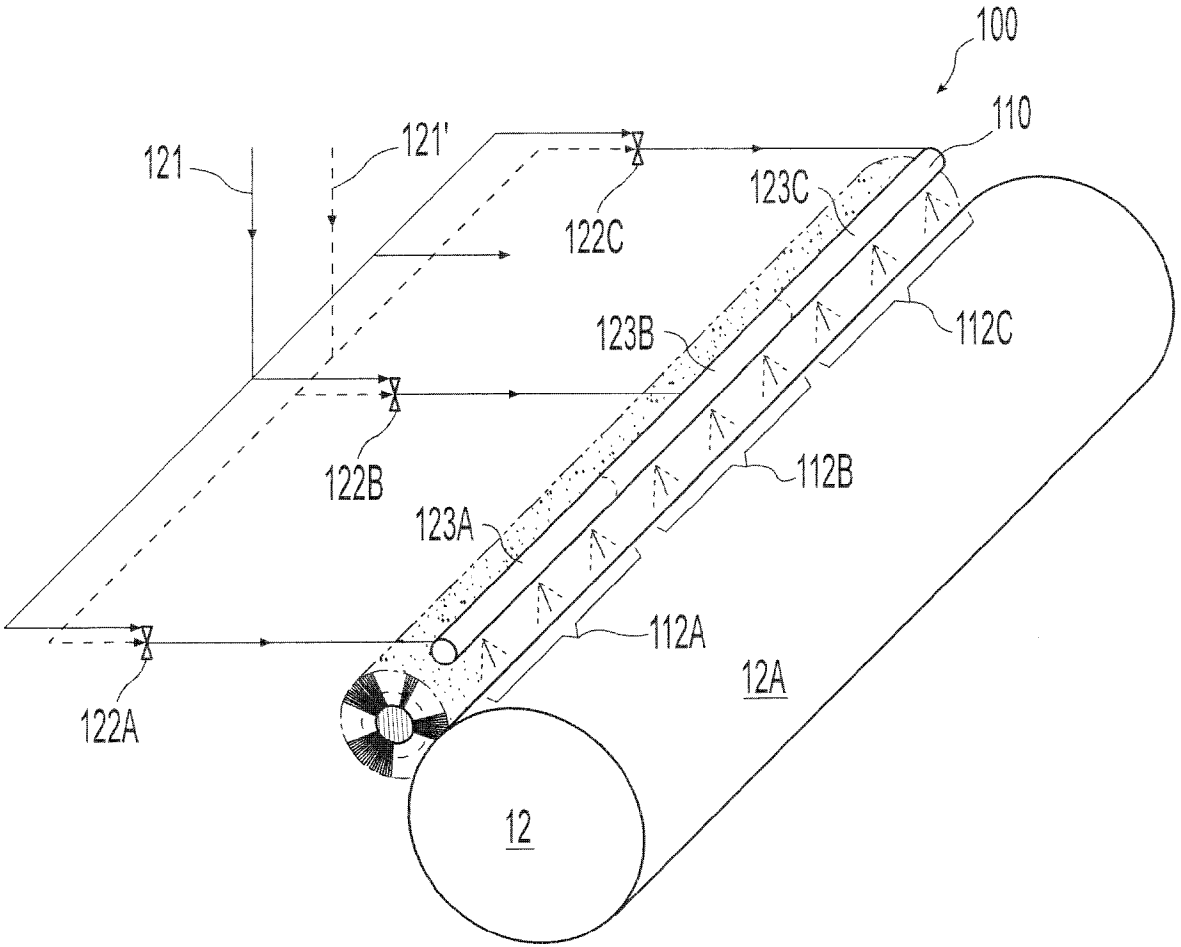
FIG. 7 is a perspective view showing a casting roll and gas nozzles delivering gas to the nip between the cleaning brush and a casting surface of a casting roll in three segments.

Turning to FIGS. 6 and 7, the gas delivery apparatus 100 delivers gas adjacent the casting surface of the casting rolls 12. This gas, so delivered, is believed to form a boundary layer of gas on the casting surfaces of the casting rolls 12 when oxides have been removed by rotating brushes. The gas may be conveyed from gas sources 121, 121' to a gas header 110 through a plurality of valves 122A, 122B, 122C, 122D and 122E as shown in FIG. 6. More than one gas source 121, 121' may be provided to enable desired and different compositions, mixtures, pressures, or combination thereof, to be delivered through the gas valves and into the gas header 110, where the gas header 110 may deliver a desired gas or gas mixture to the casting roll surfaces through the nozzles. The gas header 110 may be provided in a series of five segments 123A, 123B, 123C, 123D and 123E as shown in FIG. 6, or in a series of three segments 123A, 123B, and 123C as shown in FIG. 7, each extending along the casting surface 12A of each casting roll 12. Alternatively, the gas header 110 may provide a common gas flow or flows, and the independent nozzles along the header may be separately adjustable and controllable to separately controlled delivery of gas adjacent the casting surface in the different segments.

In any event, the gas delivery apparatus 100 is capable of delivering a different, regulated gas flow and/or gas composition adjacent the casting surface 12A of the casting rolls 12 in each segment, so that the gas flow to each segment is independently regulated in each segment. In this way, each segment may have an independently controlled gas delivery. The gas header 110 may be segmented into segments by directly connecting desired gas sources 121, 121' with certain nozzles within the header, or the segments may be maintained as separate compartments within the header, or the nozzles on the gas header may be independently regulated from the gas header 110. In any event, the gas is delivered through a plurality of nozzles positioned along the casting surface 12A of a casting roll 12 to adjacent the casting surface of the casting roll. The delivered gas is believed to go into the spaces or areas 200 from which the rotating cleaning brushes 22 have removed oxides and other contaminants 202 as shown in FIG. 8. A resulting boundary gas layer is believed to control the interfacial heat transfer coefficient between molten metal in the casting pool and the casting roll surfaces 12A. The delivered gas is expected to replace at least a portion of the gases, including oxygen and moisture, previously in the area adjacent the casting roll surfaces, and in addition potentially contaminants and other material removed by brushing.

As discussed above, the temperature of the casting roll has been found to vary along the length of the casting roll, indicating a variation in heat flux along the casting roll length. The variation in heat flux between the casting pool and the casting roll surfaces along the length of the casting roll also results in a temperature variation across the width of the cast strip adjacent the nip. The variation in temperature along the roll and across the cast strip indicates a variation in buildup of oxides along the length of the casting roll, and a variation in strip quality across the strip.

As shown in FIGS. 3 and 4, at least one temperature sensor 51, 51', 151 may be positioned to determine temperatures in segments along the length of the casting roll, of the cast strip adjacent the nip formed between the casting rolls, or a combination thereof, and generate sensor signals corresponding to the temperatures thus measured. The temperature sensor 51, 51', 151 may be an infrared scanning pyrometer, and may be a two-color infrared pyrometer. The temperature sensors 51 may be positioned to measure the temperature along the length of the casting roll between the nip and the casting area, preferably in a continuum and preferably in a position between the brush and the entry into the casting area. Alternately or in addition, the temperature sensors 51' may be positioned to measure the temperature along the length of the casting roll at any desired position between the nip and the casting area as shown in FIG. 3. Alternately or in addition, the temperature sensors 151 may be positioned to determine the temperatures across the cast strip at segments adjacent the nip, e.g., between about 0.2 meter and 1 meter from the nip as shown in FIG. 4.

In any event, the temperature sensors 51, 51', 151 are positioned to determine temperatures of, and generate sensor signals corresponding to the temperatures in segments either along the casting rolls or across the strip adjacent the nip, or both. The temperature measurements may be segmented into more than three segments, such as five or more segments, or in a continuum. The temperature sensors 51, 51', 151 may be used to determine a temperature profile along the length of the casting roll or across the cast strip adjacent the nip. The temperature profile may be a continuous temperature profile, or temperatures at selected locations in segments along the casting roll or across the cast strip. Temperatures may be determined for each of the segments 123 extending along the casting surface 12A of each casting roll 12 shown in FIGS. 6 and 7.

The signals from the temperature sensors 51, 51', 151 are directed to a controller 52 capable of receiving the sensor signals and in turn controlling the delivery of gas to each segment corresponding to temperatures in each segment as shown In FIGS. 6 and 7. Regulated by the controller 52, the gas delivery apparatus 100 is capable of delivering gas along the casting surface adjacent the rotating brush corresponding to the determined temperatures measured along the casting rolls or across the cast strip, or both. The controller 52 may also be used with sensors monitoring the heat flux, calculating the difference in heat flux from the initial heat flux measured, and controlling the energy exerted by the brush against the casting surface based in the difference in heat flux from the initial heat flux measured. Alternately or in addition, the controller 52 may control the energy of the rotating brushes against the casting roll and/or the angle of contact of the brushes with the casting roll surfaces, using the determined temperature from the temperature sensors 51, 51', 151, where the energy of the rotating brush against the casting roll may be controlled by varying the application pressure, the speed of rotation, or a combination thereof, and the angle of contact is controlled by adjusting the angle between the axis of the brush and the casting roll surface.

The gas delivered in the respective segments may be different and varied in composition, mixture, pressure, or a combination thereof, by delivering of the gas on the casting surface by control of the valves 122A, 122B, 122C, 122D and 122E as shown in FIG. 6. The plurality of gas valves are provided to control the delivery rate of the gas adjacent the casting surface 12A of the casting rolls 12 in the respective segments, and/or to control the mixing ratio when more than one gas is being delivered. The valves 122A, 122B, 122C, 122D and 122E may be automatically controlled with the controller 52. This embodiment is particularly useful, for example, in delivering gas of different mixture, pressure or composition adjacent the ends of the casting rolls, because of the difference in heat gradient adjacent the ends of the casting rolls compared to the central area of casting surface 12A of the casting roll 12. In addition, the composition, mixture, or pressure of the gas delivered through valves 122A, 122B, 122C, 122D and 122E to one or more of the segments along the casting surface 12A of the casting roll 12 may be varied in similar manner during the casting campaign to enable the heat flux from the molten melt to the casting rolls to be controlled for desired results.

Alternately, the gas header 110 includes a plurality of nozzles positioned along the casting surface 12A, for example, in groups comprising 1 or more nozzles, and the gas delivered by each group of nozzles is controlled independently. Each nozzle group corresponds with a segment on the casting surface. In this alternate, the controller 52 controls the composition, mixture, pressure, or a combination thereof, of delivery of gas through each nozzle group corresponding to the measured temperature of the corresponding segment. In this way, the quality of the cast strip can be varied and independently controlled in each segment to control and provide a better quality cast strip.

The gas comprises at least one gas selected from the group consisting of nitrogen, argon, helium, hydrogen, water vapor, carbon monoxide, carbon dioxide, dry air, or a mixture of two or more thereof. In addition, more than one gas header 110 may be provided in parallel or in series along the casting surface of the casting roll to provide for delivery of the same gas or mixture, or different gases or mixtures, adjacent the casting surface of the casting roll.

The gas header 110 may be provided to deliver gas in the brush nip between the cleaning brush 22 and the casting surface 12A of the casting roll 12 as shown in FIGS. 2 through 7 to deliver the gas adjacent the casting surface as the oxides are removed. Alternately or in addition, the gas header 110' may be positioned adjacent the cleaning brush 22 along the casting surface of the casting roll between the brush and the casting area as shown in ghosting on FIGS. 3 and 4. Alternately or in addition, the gas header 110" may be positioned adjacent the cleaning brush 22 along the casting surface of the casting roll between the nip between the casting rolls and the brush as shown in ghosting on FIGS. 3 and 4. If desired, the gas may also be delivered through the housing 120 adjacent the cleaning brush 22 as shown in FIGS. 3 and 4. However, it is expected that the closer the gas header 110 delivers the gas to where the oxides are removed by the rotating brush the more effective the present method and apparatus for control of the heat flux.

Although the invention has been illustrated and described in detail in the foregoing drawings and description with reference to several embodiments, it should be understood that the description is illustrative and not restrictive in character, and that the invention is not limited to the disclosed embodiments. Rather, the present invention covers all variations, modifications and equivalent structures that come within the scope and spirit of the invention. Additional features of the invention will become apparent to those skilled in the art upon consideration of the detailed description, which exemplifies the best mode of carrying out the invention as presently perceived. Many modifications may be made to the present invention as described above without departing from the spirit and scope of the invention.

What is claimed is:

1. A method of continuous casting of thin cast strip comprising the steps of:

assembling a pair of counter-rotating casting rolls laterally to form a nip between circumferential casting surfaces of the casting rolls through which metal strip may be cast, forming a casting pool of molten metal supported on the casting surfaces of the casting rolls above the nip to form a casting area with a protective atmosphere, assembling a rotating cleaning brush such that the periphery of the brush contacts the casting surface of each casting roll between the nip and the casting area, counter-rotating the casting rolls such that the casting surfaces of the casting rolls each travel toward the nip to produce a cast strip downwardly from the nip, removing oxides from the casting surface of each casting roll by contacting the casting surface of each casting roll with the rotating cleaning brush, determining temperatures of at least one casting roll in segments along the casting surface of the casting roll, of the cast strip in segments laterally across the strip adjacent the nip, or a combination thereof, and delivering gas adjacent the casting surface regulated by segment adjacent the nip of the cleaning brush in segments corresponding to the temperature determined in each segment.

2. The method of continuous casting of thin cast strip as claimed in claim 1, where the gas in the gas delivery step is variable in composition, mixture, pressure, or a combination thereof in at least five segments along the casting rolls.

3. The method of continuous casting of thin cast strip as claimed in claim 1, where at least five segments are provided along the casting surfaces of the casting rolls or across the cast strip adjacent the nip.

4. The method of continuous casting of thin cast strip as claimed in claim 1, where the step of determining temperature in segments is performed in a continuum.

5. The method of continuous casting of thin cast strip as claimed in claim 1, where the step of determining temperatures comprises:

determining temperatures in locations in segments along at least one casting roll.

6. The method of continuous casting of thin cast strip as claimed in claim 1, where the step of determining temperatures comprises:

determining temperatures in segments is across the cast strip between about 0.2 meter and 1 meter from the casting roll nip.

7. The method of continuous casting of thin cast strip as claimed in claim 1 where the step of delivering gas at the casting surface comprises:

introducing the gas into a housing provided adjacent the cleaning brush.

8. The method of continuous casting of thin cast strip as claimed in claim 1, further comprising the step of:

controlling the energy of the rotating cleaning brushes against the casting surface, an angle of contact of the brushes with the casting surface, or a combination thereof using the determined temperatures, where the energy of the rotating brush is controlled by varying the application pressure, the speed of rotation, or a combination thereof, and the angle of contact is controlled by adjusting the angle between the axis of the brush and the casting roll surface.

9. The method of continuous casting of thin cast strip as claimed in claim 1, where the gas of the gas delivery step comprises at least one gas selected from the group consisting of nitrogen, argon, helium, hydrogen, water vapor, carbon monoxide, carbon dioxide, dry air or a mixture of two or more thereof.

10. An apparatus for continuous casting thin cast strip comprising:

a pair of counter-rotating casting rolls spaced laterally to form a nip between circumferential casting surfaces of the casting rolls through which thin cast strip may be discharged downwardly and a casting area capable of forming a casting pool above the nip with a protective atmosphere;

rotating cleaning brushes capable of removing oxides from the casting surfaces of each casting roll, positioned to remove such oxides from the casting surfaces in an area between the nip and the casting area;

a housing provided adjacent each cleaning brush;

at least one temperature sensor capable of providing sensor signals corresponding to the temperatures of at least one casting roll in at least three segments along the casting roll, of the cast strip in at least three segments across the strip, or a combination thereof;

gas nozzles capable of directing a flow of gas through the housing adjacent the casting surface of each casting roll between the rotating brush and the casting area regulated in at least three segments; and a controller capable of receiving the sensor signals and controlling the delivery of gas through the gas nozzles to each segment corresponding to temperatures determined in each segment.

11. The apparatus for continuous casting thin cast strip as claimed in claim 10, further comprising a gas delivery apparatus adapted to deliver at least one gas selected from the group consisting of nitrogen, argon, helium, hydrogen, water vapor, carbon monoxide, carbon dioxide, dry air or a mixture of two or more thereof through the gas nozzles.

12. The apparatus for continuous casting thin cast strip as claimed in claim 10, where the flow of gas to each segment is variable in composition, mixture, pressure, or a combination thereof in at least five segments along the casting surfaces of the casting rolls.

13. The apparatus for continuous casting thin cast strip as claimed in claim 10, wherein at least one temperature sensor is capable of providing sensor signals corresponding to the temperatures across the cast strip between about 0.2 meter and 1 meter from the casting roll nip.

14. The apparatus for continuous casting thin cast strip as claimed in claim 10, where at least one temperature sensor is capable of providing sensor signals corresponding to the temperatures in a continuum across the cast strip.

15. The apparatus for continuous casting of thin cast strip as claimed in claim 10, where at least one temperature sensor is capable of providing sensor signals corresponding to the temperatures in locations in segments along at least one casting roll.

* * * * *